United States Patent [19]

Nothdurft

[11] Patent Number: 4,497,480

[45] Date of Patent: Feb. 5, 1985

[54] EJECTOR MECHANISM FOR INCOMPLETE FASCICLES IN A CONVEYOR LINE

[75] Inventor: Edgar Nothdurft, Grosserlach, Fed. Rep. of Germany

[73] Assignee: Maschinenbau Oppenweiler GmbH, Oppenwiler, Fed. Rep. of Germany

[21] Appl. No.: 557,234

[22] Filed: Dec. 2, 1983

[30] Foreign Application Priority Data

May 18, 1983 [DE] Fed. Rep. of Germany ..... 3318047

[51] Int. Cl.[3] ..... B65H 39/02

[52] U.S. Cl. ..... 270/58; 271/303; 271/305; 198/530

[58] Field of Search ..... 270/52–56, 270/58; 271/303, 305; 198/361, 362, 530, 531, 526, 529

[56] References Cited

U.S. PATENT DOCUMENTS

| | | | |
|---|---|---|---|
| 2,675,119 | 4/1954 | Birch | 198/531 X |
| 3,556,518 | 1/1971 | Brockmueller | 271/303 |
| 3,669,442 | 6/1972 | Thomas | 270/58 |
| 3,669,448 | 6/1972 | Schieven et al. | 271/305 |
| 3,866,902 | 2/1975 | Feldkamper | 271/303 |
| 3,899,165 | 8/1975 | Abram et al. | 270/58 |
| 3,904,019 | 9/1975 | Carlen et al. | 198/362 |
| 3,918,572 | 11/1975 | Wirth et al. | 198/530 |
| 4,047,712 | 9/1977 | Burkhardt et al. | 271/305 |
| 4,068,212 | 1/1978 | Templeton | 271/303 |
| 4,447,052 | 5/1984 | Muller | 271/305 |

FOREIGN PATENT DOCUMENTS 1218401 6/1966 Fed. Rep. of Germany ..... 270/54

*Primary Examiner*—E. H. Eickholt

*Attorney, Agent, or Firm*—Hopgood, Calimafde, Kalil, Blaustein & Judlowe

[57] ABSTRACT

The invention contemplates mechanism for ejecting incomplete fascicles (H) which are astride a transport rail (1) and are carried along by driver means (3, 4) moving in the lengthwise direction of this transport rail. The ejector mechanism has a guide rail (9) which starts at an offset from the transport rail (1) that is greater than the thickness of complete fascicles (H) and which extends from this starting end upward and to the side at an acute angle to the direction of movement of the fascicles moving along the transport rail (1); the upward slope peaks at a highest point, the location of which (with respect to the transport rail) is selected such that incomplete fascicles (H) leave the active region of the driver means (3) only after the center of gravity of the fascicle has passed the highest point of the guide rail (9). From this point to its end, the guide rail has a downward slope which is sufficient to promote gravitational movement of the incomplete fascicles (H), on their own, to the discharge end of the guide rail. A switch tongue (6) is movable between (a) a first position in which it forms a guide path for the incomplete fascicles (H) from the transport rail (1) to the starting end of the guide rail (9) and (b) a second position in which it permits the transport of complete fascicles through the intermediate space between the transport rail (1) and the starting end of the guide rail (9).

10 Claims, 6 Drawing Figures

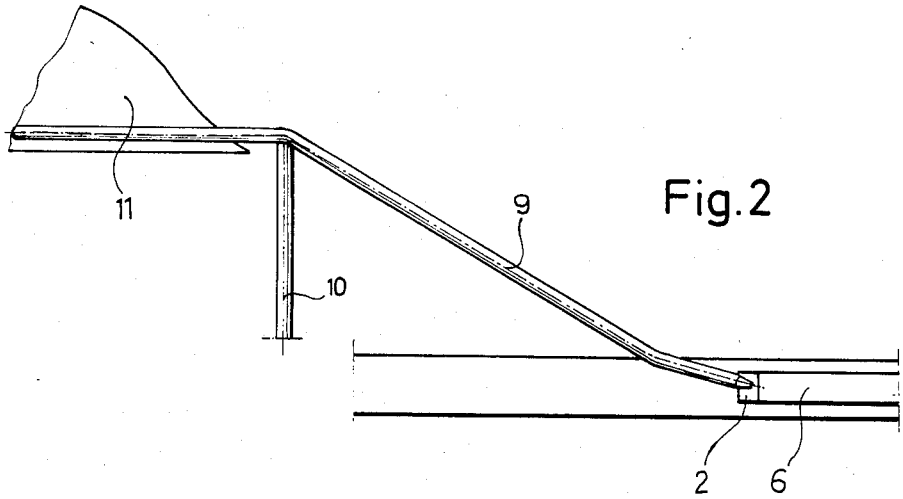
Fig. 2
Fig. 3
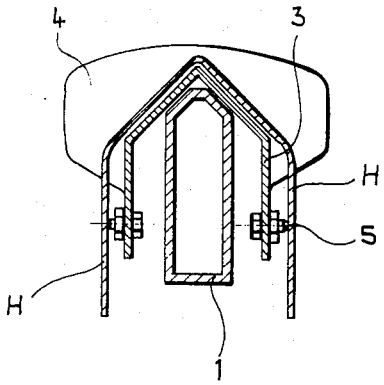
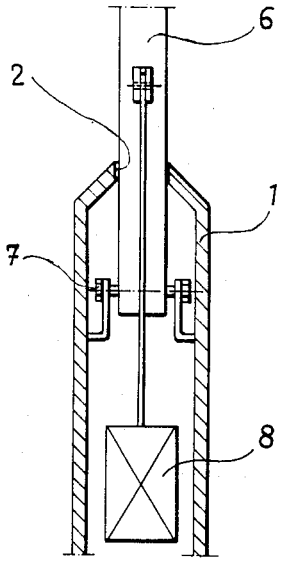
Fig. 4

EJECTOR MECHANISM FOR INCOMPLETE FASCICLES IN A CONVEYOR LINE

BACKGROUND OF THE INVENTION

The invention relates to means for ejecting incomplete fascicles from a continuously running fascicle-conveyor system.

In the machine-forming of fascicles consisting of individual folded sheets, it often happens that one or more sheets are missing, and the fascicle is therefore incomplete. Such incomplete fascicles must be sorted out before the fascicles are fed to other processing stations. In the forming of the fascicles, the sheets are deposited from above upon a transport rail (which forms a saddle) or upon other sheets which have already been placed astride the transport rail, and the fascicles arrive at an ejector in rail-straddling position. Known ejectors engage underneath the fascicle while it is astride the transport rail, then lift it from the transport rail and transport it by moving-transport means to a collection point. Known ejectors must carry out relatively complicated movements and are, therefore, expensive devices which, furthermore, do not permit attainment of a high operating speed, so that the ejector may be the factor preventing an increase in operating speed of the entire unit.

BRIEF STATEMENT OF THE INVENTION

The object of the invention is to provide an ejector for incomplete fascicles which is of the simplest possible construction and which nevertheless operates reliably and also permits high transport speeds.

The invention achieves this object in the context of a conveyor rail along which fascicles are continuously advanced by driver elements. A guide rail having an upward slope, and also directed laterally of the conveyor rail, is sufficiently offset from the conveyor rail to avoid interference with normal movement of completed fascicles. But if an incomplete fascicle comes along, a switch tongue is operative to establish an up-ramp which deflects the incomplete fascicle onto the guide rail, the incomplete fascicle being advanced up to and past the peak of the guide rail, by propelling action of the same driver element. Once past the peak of the guide rail, the ejected fascicle gravitationally descends on the guide rail to a suitable means of collection.

Such an ejector literally consists of only two movable elements, namely, the switch tongue and its actuating means, and one stationary element, namely, the guide rail. A separate transport device for transporting the fascicle to be sorted out along the guide rail is not necessary, since such transport is effected by the driver means associated with the transport rail up, at least to that point from where the fascicle can proceed gravitationally, under the effect of its own weight.

The solution in accordance with the invention, therefore, represents an optimum in terms of simplicity of construction and required expense, particularly since the structural components themselves are extremely simple. Transport of incomplete fascicles along the guide rail can proceed just as rapidly as along the transport rail, so that the ejector does not limit transport speed. Another advantage is that the ejector of the invention requires no maintenance and is extremely insensitive to disturbance.

For a simple control, which can possibly be effected by an electronic monitoring device, an electromagnet is provided as the actuator for the switch tongue, in a preferred embodiment. The switch tongue could be formed, for example, by a resilient tongue which is fixed at one of its ends. However, a switch tongue in the form of a pivotally mounted lever is also advantageous.

In a preferred embodiment, the transport rail advantageously has a cavity open near the starting end of the guide rail, and the entire switch tongue is received in this cavity while in active position, being projected out of the open cavity (for alignment with the starting end of the guide rail) only when a fascicle is to be ejected; this is not only simple but also affords protection of the switch tongue and its actuating means. Also, the further advantage is obtained that the switch tongue can in no way interfere with transport of complete fascicles. Further advantageously, the switch tongue may be a lever, pivoted on a horizontal axis, all contained within the transport rail, and an electromagnet for actuating the switch tongue (together with its coupling thereto) may also be accommodated within the transport rail, for example, underneath the switch tongue.

To facilitate transfer of incomplete fascicles to the guide rail, it is advisable to position the starting end of the guide rail above the transport rail. The ejected fascicle then need undergo only an additional movement in the upward direction. In principle, however, it is also possible to arrange the starting end of the guide rail toward one side of the transport rail.

The guide rail may be developed in various ways. For example, instead of simple bars, hollow profiles are also suitable. As a rule, however, a simple round bar will suffice.

To facilitate or make possible an ordered collection of ejected incomplete fascicles, a slide path can be provided alongside the ejector-guide rail; in the course of its movement along the guide rail, one outer side of an incomplete fascicle develops glancing engagement with the slide path. The slide path may twist continuously from an initial steep inclination to the horizontal (i.e., inclination with respect to the horizontal plane locally transverse to the longitudinal direction of the guide rail); this inclination decreases continuously to the other end of the slide path, by an amount which is at least approximately equal to the initial inclination of the initially engaged outer side of an ejected fascicle. By this means, the fascicle is brought from a vertical to a horizontal position in the course of its transport along the guide rail, so that at the end of the guide rail it can be deposited in a horizontally oriented position.

DETAILED DESCRIPTION

The invention will be described in detail in conjunction with the acocmpanying drawings, in which:

FIG. 2 is a simplified plan view of the embodiment of FIG. 1;

FIG. 3 is an enlarged section, taken at the line III—III of FIG. 1;

FIG. 4 is another enlarged section, taken at the line IV—IV of FIG. 1.

Figure 1:
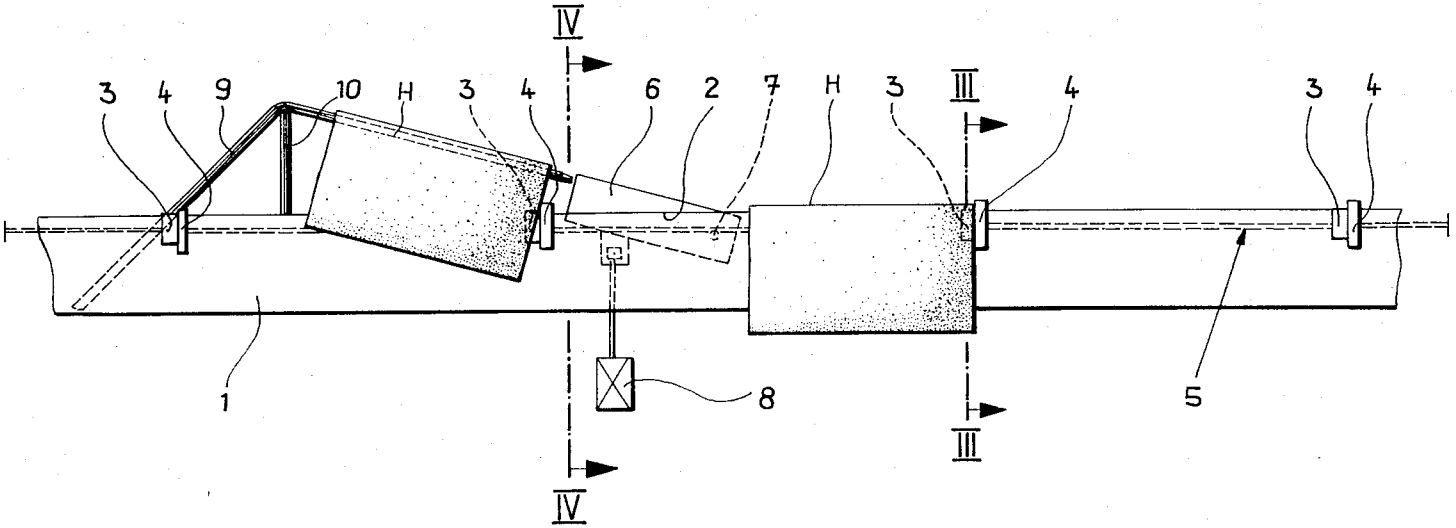
FIG. 1 is a simplified side view in elevation of an embodiment of the invention.

The drawings show mechanism for sorting out incomplete fascicles from a sequence of fascicles H, continuously advanced in the right-to-left direction of FIG. 1. The fascicles H comprise two or more folded sheets, nested one above the other and astride a transport rail 1, here shown as straight and horizontal. Rail 1 is developed as a hollow profiled rail, and at the location where the incomplete fascicles are to be removed, rail 1 has an opening 2 in its upper side, i.e., in the side which forms the saddle for the fascicles. As shown in FIG. 3, drivers 3 ride, as do the fascicles, along the transport rail 1 and have laterally protruding stops 4 which engage the rear end of the fascicle at or near its back, thereby reliably advancing the fascicle. In the form shown, reliable driving engagement with the fascicles is assured by the development of stops 4 as large-area tabs.

The drivers 3 are elements of an endless conveyor chain 5, for example, a so-called gathering chain, of which only the upper course is shown diagrammatically in FIG. 1. This chain will be understood to be driven by known drive means (not shown) which runs synchronously with those conveyor devices which transfer the fascicles to the transport rail 1 and which remove them from it.

In the transport rail 1, at the location of opening 2 on its upper side, a switch tongue 6 is pivotally mounted via a horizontal pivot pin 7 which extends normal to the longitudinal axis of transport rail 1. This switch tongue is developed as a swing lever and is, in the form shown, a flat elongate bar standing on edge. The pivot pin 7 mounts bar 6 in the vicinity of that end which is first encountered by fascicles conveyed along transport rail 1. The fascicles move therefore in the direction from the articulated end to the free end of switch tongue 6. The actuating rod of an electromagnet 8 has articulated connection to the switch tongue 6, at a location offset from pin 7. Electromagnet 8 is arranged in the transport rail 1 beneath the switch tongue, but it could also be located elsewhere. When electromagnet 8 is not excited, the switch tongue 6 extends in the lengthwise direction of the transport rail 1 and does not protrude thereabove. On the other hand, when electromagnet 8 is excited, then it holds switch tongue 6 in the position shown in FIG. 1, i.e., with tongue 6 protruding upward out of the transport rail 1 and at an acute angle thereto, thereby forming an ascending fascicle ramp, in the transport direction. Upon arrival at the switch tongue 6, a fascicle to be ejected is shoved up the ramp by the driver 3 which is advancing the particular fascicle.

The switch tongue 6 forms, together with the armature of electromagnet 8, the movable part of an ejector for incomplete fascicles H. In addition to this movable part, the ejector has only a stationary guide rail 9 which, in the form shown, is a round bar, although it could also be a bar having a different cross-section, or else a plate which makes possible a straddle accommodation of fascicles to be ejected. The starting end of guide rail 9 is at such vertical offset above transport rail 1 that complete fascicles can be unimpeded in their continuous movement along the transport rail 1 beneath the starting end of rail 9. The length of the switch tongue 6 and the inclined slope (when in its upwardly projected state) are so selected (a) that, between the free end of the switch tongue 6 and the starting end of the guide rail 9, there is only a small gap, and (b) that the upper edge of the free end of switch tongue 6 is at least at the elevation of the upper side of the starting end of guide rail 9, or slightly higher, thus assuring smooth and undisturbed transfer of fascicles to be ejected from switch tongue 6 onto guide rail 9. For the same reason, the starting end of guide rail 9 is preferably a wedge-shaped knife edge, as shown in FIG. 2.

As shown in FIGS. 1 and 2, guide rail 9 extends from its starting end obliquely upward and obliquely to the side; more specifically, rail 9 is shown inclined at an angle of approximately 15° upward and, for a short distance, laterally to one side, at a substantially equal angle; this lateral angle then increases to an angle of approximately 30°. These two lateral directions of rail 9 are without interruption of the substantially continuous ramp slope which commences along the top edge of tongue 6, when in projected position. The slope of rail 9 reaches a peak bend, beyond which rail 9 slopes downwardly at lateral offset from the transport rail 1. The peak bend of guide rail 9 is at sufficiently close offset from the transport rail 1 to insure that a fascicle which has been driven onto the guide rail 9 will follow the guide rail 9 upon further driven displacement, even when parts of the edges of the fascicle are still resting against the transport rail 1. In selecting the location of this bend, which forms the highest point of guide rail 9, it should be further taken into consideration that the drivers 3 are able to transport the fascicle to be ejected along the guide rail 9 until the center of gravity of the fascicle has passed beyond the bend; i.e., the center of gravity should pass this bend before the fascicle leaves the region of thrusting effectiveness of the drivers. In the device shown, the bend at the highest point of guide rail 9 is approximately 150 mm to the side of and about 90 mm above the transport rail 1.

The section of the guide rail 9 which follows the bend is shown to extend parallel to the transport rail 1, but it could alternatively have any other direction with respect to the transport rail 1. It is important that this section have a downward slope which is sufficient for fascicles to slide gravitationally, on their own, to the free end of the guide rail 9 or beyond, in order that no conveying members be required for transport of ejected fascicles, once they have left the thrust-effective region of the drivers 3. The guide rail 9 shown therefore has a down slope, following the bend, at an angle of approximately 45° to the horizontal. Supports 10 or the like hold guide rail 9 in the described position.

If it is desired to have an ordered deposit of ejected fascicles, for example a stacking, a slide path can be provided alongside guide rail 9, preferably adjacent to the down-slope section; such a slide path is suggested at 11 and may be defined by one or more plates or even by a single rail. This slide path 11 has a twist; at its starting end (shown in FIG. 2 on the right) against which one of the outer sides of an ejected fascicle rests, the slide path 11 is approximately in a vertical plane—its inclination, transverse to the direction of movement of ejected fascicles H, and also transverse to the longitudinal extension of the guide rail 9, is therefore in the order of 90° to the horizontal. Toward the end of the twist, this transverse inclination of slide path 11 decreases continuously until it reaches, for example, a value of zero. This means that each fascicle, in the course of its movement along guide rail 9, is deflected in partial rotation about its lengthwise axis, effecting fascicle displacement from vertical to horizontal orientation. Since ejected fascicles leave the guide rail 9 in a horizontal orientation, they can be deposited on a stack.

Figure 5:
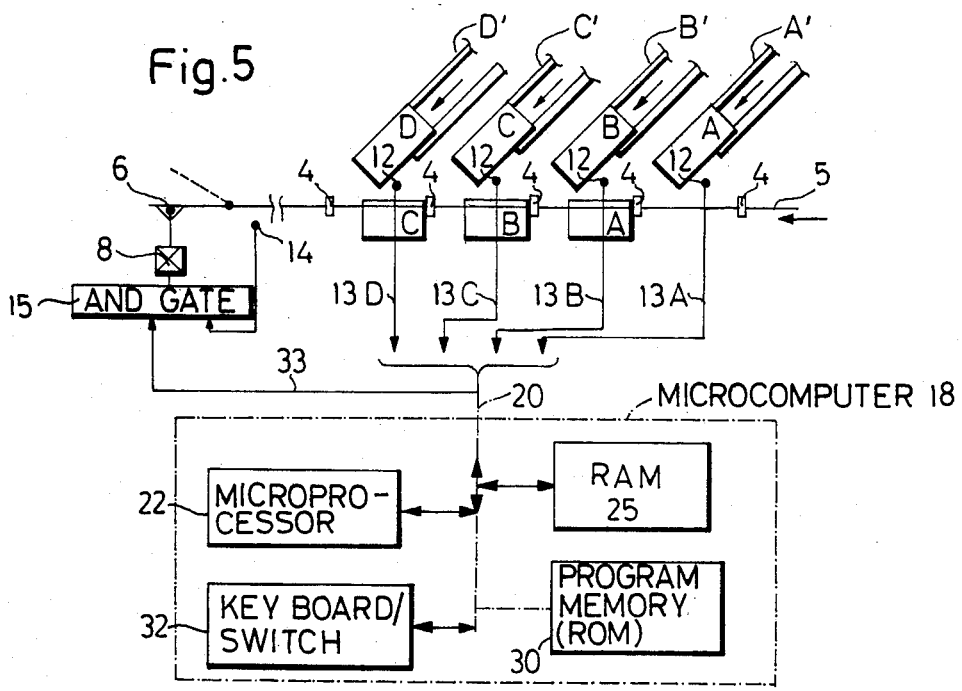
FIGS. 5 and 6 are schematic diagrams to illustrate further embodiments of the invention.
Figure 6:
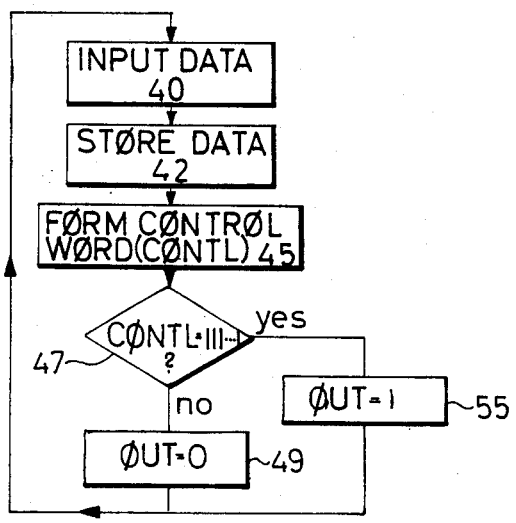

It will be understood that the described conveyor line with switch tongue 6 lends itself to automated rejection of an incomplete fascicle without interruption of the continuous fascicle-advancing movement of conveyor chain 5 and its fascicle-driving stops 4. FIGS. 5 and 6 are illustrative of components and functions to achieve such automated operation.

In FIG. 5, the spaced stops 4 on chain 5 will be recognized, leading to switch tongue 6 and its actuating solenoid 8, rail 1 being omitted from FIG. 5 for simplified showing. Four single-sheet fascicle-loading stations A'-B'-C'-D' are shown at the instant of time when a first fascicle sheet A has already been loaded on the conveyor and is about to be loaded (at station B') with a second fascicle sheet B; at the same time, and just ahead of the next-downstream stop 4, a third fascicle sheet C is about to be loaded (at station C') onto the A-plus-B sheet combination; and also at the same time, and just ahead of the next further downstream stop 4, a fourth fascicle sheet D is about to be loaded (at station D') onto the A-plus-B-plus-C combination. An optical monitoring element, such as a light-beam and photo-cell barrier 12, is symbolized by heavy dot at each of the loading stations and will be understood to produce an output pulse (a binary output) in its output line (13A, 13B, 13C, or 13D) to signal the fact of correctly loading each sheet at its proper station, by light-beam interruption, once per unit fascicle-advance cycle.

A microcomputer 18 is supplied by the respective output lines 13A, 13B, 13C, 13D, and if a light beam fails to be interrupted when it should be, the microcomputer remembers the fascicle which is to be thereupon signalled as incomplete; and, in the correct cycle of arrival of the incomplete fascicle at the ejection point, a further light-beam or barrier device 14 is operative to identify the correct instant of time for actuation of the eject/solenoid 8. As shown, an AND-gate 15 assured that solenoid 8 will only be operative if the next fascicle to arrive at the ejection station 6 has been identified as "incomplete" by the microcomputer 18 (via an output lead 33).

The ensemble of binary outputs from the optical monitoring elements 12 during each sheet-dispensing interval are supplied to microcomputer 18. In overview, microcomputer 18 stores the multi-bit digital word characterizing sheet-delivery performance for each fascicle-feeding cycle. If each feeder station (A', B', C', D') performed correctly, the light path for each optical sensor 12 is interrupted (an assumed binary "1"), thereby supplying a digital word characterized by all binary "1" values to the microcomputer 18. Correspondingly, if any sheet-feeding station malfunctioned, the corresponding optical sensor 12 does not have its light path interrupted, thereby supplying a Boolean "0" in the appropriate digit position to the microcomputer 18.

Continuing in overview, as the fascicle (collection of sheets) reaches the accept/reject station 6, the microcomputer 18 supplies a digital control signal (processing variable OUT discussed below) via lead 33 which causes the fascicles to be accepted (binary "1" on lead 33) or rejected (binary "0"). The microcomputer performs its quality-assurance function by examining each internally stored digital word developed as the subject sheet collection which is to be next acted upon by the accept/reject station passes under the several sheet-feeding stations. It will be apparent, assuming n feeder stations, that n stored binary words must be examined utilizing from each word only one digit corresponding to a diagonal bit array. If that diagonal bit array includes only binary "1's", indicating correct performance when the fascicle-sheet collection was being developed, the feeding system performed correctly, and microcomputer 18 issues a favorable binary "1" level for the ØUT control signal on lead 33. Correspondingly, if a binary "0" appears anywhere in the diagonal of the stored data corresponding to the subject document correction, a binary "0" ØUT signal is furnished to lead 33, causing the page collection to be rejected.

The microcomputer 18 for effecting the above mode of operation may illustratively include a digital microprocessor 22 of any form coupled in a common bus mode to data and address buses 20. Also connected to the buses 20 are a program-containing read only memory (e.g. ROM) 30, a scratch-pad (e.g. RAM) memory 25 for storing the data developed by the optical sensors 12 (deemed DATA for processing purposes below discussed), and a manual entry device (e.g., a keyboard, or thumb-wheel switches) 32 for entering the number of feeder stations. Under control of the program stored in ROM 30, successive process/characterizing digital words (DATA) are stored in the RAM 25 during successive sheet-feeding operations. The appropriate stored DATA is extracted from RAM 25 to determine whether the feeder process was performed correctly, and a suitable binary value is supplied via output lead 33 to accept or reject the documents next arriving at the accept/reject station.

Many modes of operation and programs for the microcomputer 18 will be readily apparent to those skilled in the art. To illustrate one mode of operation, and with additional reference to FIG. 6, during each feeding operation, the outputs of the sensors 12 (DATA) are read into the microprocessor (functional step 40) and stored in the scratch-pad memory 25 (step 42). For accept/reject decision purposes, the microprocessor 22 forms (in a location in memory 25) a control word (CØNTL) which characterizes the performance of the feeding stations at each station along the conveyor track (rail 1) for the fascicle to next reach the accept/reject station. Again, many techniques are known to those skilled in the art for developing such a control word. For example, the most significant bit of the control word (CØNTL) may be formed via a logical AND function between a mask having a "1" in the most significant bit and a "0" elsewhere, and the DATA word stored in RAM 25 may be developed when a sheet A is observed by means 12 to have been correctly loaded on rail 1 at the rightmost feeder station A' shown in FIG. 5. Correspondingly, the next most significant bit is formed by logically ANDing a mask having a binary "1" only in the second most significant digit location with the DATA word formed when the conveyed sheet A was observed to receive the second sheet B at the feeder station B' in the second most-right position, and so forth. This control (CØNTL) word formed during step 45 is next tested (operation 47) to determine whether the word is formed of all Boolean "1's". If it is (YES output of test 47), the output signal (ØUT) is set to "1" (step 55) causing lead 33 to furnish an acceptance signal. Correspondingly, if a Boolean "0" appears anywhere in the CØNTL word, the resulting "NØ" output of test 47 causes a "0" level OUT signal on lead 33 (step 49), causing the particular incomplete fascicle to be reached and ejected. Program control then returns to operation 40 to accept data for the next following cycle of operation.

What is claimed is:

1. An ejector for incomplete fascicles which, in a straddle arrangement on a transport rail, are carried along by driver means moving in the lengthwise direction of said transport rail, characterized by (a) a guide rail (9) which starts at a distance from the transport rail (1) that is greater than the thickness of the complete fascicles and extends upward and to the side from this starting end at an acute angle to the direction of movement of the fascicles moving along the transport rail (1) up to a highest point whose position with respect to the transport rail (1) is selected such that the incomplete fascicles (H) leave the active region of the driver means (3) only after the center of gravity of the fascicle has moved past the highest point of the guide rail (9), said guide rail having a down-slope toward its end which is sufficient for transport of the incomplete fascicles past this end under the weight of the fascicles themselves, and (b) a switch tongue (6) which is movable between a first position in which it forms a guide path for the incomplete fascicles (5) from the transport rail (1) to the starting end of the guide rail (9) and a second position in which it permits the transport of fascicles through the intermediate space between the transport rail (1) and the starting end of the guide rail (9).

2. An ejector according to claim 1, characterized by an electromagnet (8) as drive means for the switch tongue (6).

3. An ejector according to claim 1, characterized by the fact that the switch tongue (6) is developed as a swingably mounted lever.

4. An ejector according to claim 1, characterized by the fact that the transport rail (1) has toward the starting end of the guide rail (9), an open cavity which completely receives the switch tongue (6) in its second position and out of which the free end of the switch tongue (6) can be moved toward the starting end of the guide rail (9).

5. An ejector according to claim 2, characterized by the fact that the switch tongue (6) is a swingably mounted lever and is mounted via a horizontal pin (7) in the transport rail (1), and that the electromagnet (8) is mounted beneath the switch tongue (6) and is coupled thereto at an offset distance from the pin (7).

6. An ejector according to any one of claim 3, characterized by the fact that the starting end of the guide rail (9) is positioned above the transport rail (1).

7. An ejector according to any one of claim 1, characterized by the fact that the guide rail (9) is formed of a round bar.

8. An ejector according to any one of claim 1, characterized by the fact that alongside or following the guide rail (9) a slide path (11) is positioned for engagement by one of the outer sides of an ejected incomplete fascicle (H) moving along the guide rail, the slide path (11) having a predetermined initial inclination transverse to the longitudinal direction of the guide rail (9), said predetermined initial inclination being with respect to the horizontal plane and at least approximately equal to the inclination of said one outer side of the fascicle in entering engagement therewith, the inclination thereafter decreasing continuously to the end of the slide path (11).

9. An ejector according to claim 8, characterized by the fact that the slide path (11) is arranged alongside the section of the guide rail (9) which has the down slope.

10. An ejector according to claim 1, in which said switch tongue includes remotely operable means for actuating the same, and in which said remotely operable means includes means synchronized with movement of said driver means and operative to detect the presence of an incomplete fascicle prior to the time when the incomplete fascicle is advanced to the location of said switch tongue.

* * * * *